US005168691A

United States Patent [19]

Errani

[11] Patent Number: 5,168,691

[45] Date of Patent: Dec. 8, 1992

[54] AUTOMATIC PLASTIC FILM WRAPPING MACHINE PARTICULARLY SUITABLE FOR SUITCASE

[75] Inventor: Franca Errani, Bologna, Italy

[73] Assignee: Derifan S.p.A., Montecorvino Pugliano, Italy

[21] Appl. No.: 610,362

[22] Filed: Nov. 7, 1990

[30] Foreign Application Priority Data

Nov. 8, 1989 [IT] Italy ..... 3696 A/89

[51] Int. Cl.[5] ..... B65B 13/00

[52] U.S. Cl. ..... 53/587; 53/211; 53/556

[58] Field of Search ..... 53/211, 441, 556, 587, 53/588

[56] References Cited

U.S. PATENT DOCUMENTS

| | | | |
|---|---|---|---|
| 4,204,377 | 5/1980 | Lancaster et al. | 53/587 X |
| 4,232,501 | 11/1980 | Stackhouse | 53/587 X |
| 4,283,903 | 8/1981 | Mayhall et al. | 53/587 |
| 4,299,076 | 11/1981 | Humphrey | 53/587 |
| 4,300,326 | 11/1981 | Stackhouse | 53/587 X |
| 4,429,514 | 2/1984 | Lancaster et al. | 53/556 |
| 4,432,185 | 2/1984 | Geisinger | 53/587 X |
| 4,597,516 | 7/1986 | Mayhall, Jr. et al. | 53/587 X |
| 4,619,102 | 10/1986 | Geisinger | 53/587 X |
| 4,949,533 | 8/1990 | Bate | 53/588 X |

*Primary Examiner*—Lowell A. Larson
*Assistant Examiner*—Daniel Moon
*Attorney, Agent, or Firm*—Herbert Dubno

[57] ABSTRACT

An automatic plastic film wrapping machine including a shaped body, a turn-table connected thereto and receiving an item to be wrapped and a machine provided with the apparatuses for load steadiness, turn-table rotation the plastic film entrainment and for cutting, allows the plastic film to be wrapped around the load, particularly, suitcases of different sizes, and provides avoiding the damages resulting from shocks or scratches during handling and transport of the load.

5 Claims, 4 Drawing Sheets

AUTOMATIC PLASTIC FILM WRAPPING MACHINE PARTICULARLY SUITABLE FOR SUITCASE

FIELD OF THE INVENTION

The present invention relates to an automatic plastic film wrapping machine having a turn-table for wrapping articles, in particular, suitcases.

BACKGROUND OF THE INVENTION

Currently, wrapping machines having turn-tables and adopted to package products, either palletised or not, by wrapping an appropriate plastic film around them are known commonly, these machines consist of a turn-table with a load to be wrapped, and placed on the turn-table a gripper for grasping a film fastened to the turn-table, so that the unwinding of the plastic film from the reel and the wrapping of the load are carried out at the same time. After a given number of revolutions, or when the wrapping is completed, a cutting device cuts the film off thus permitting the displacement of the wrapped load from the turn-table. The wrapping machines are usually designed for working with big loads and/or heavy ones.

It is also known that, in the case of wrapping of light and/or unsteady loads, the machine is provided with a top-platen that applies pressure stability along a vertical axis of the turn-table in order to maintain load. This system of vertical pressure prevents the load from moving and/or overturning during the wrapping cycle, but it requires a load being axially centered with a high degree of precision on the table. It is obvious that such machine is not effective for light and/or small loads, such as, for instance, individual suitcases, furthermore, such machine must be run by a trained operator.

OBJECT OF THE INVENTION

It is therefore the object of the present invention to provide a machine with the turn-table particularly suitable for wrapping a plastic film around small loads, such as suitcases and similar. Still another object is to minimize the overall dimensions of the machine in order to allow the use of the machine also in small areas.

SUMMARY OF THE INVENTION

The machine comprises a body with a turn-table connected thereto and provided with two locating elements (a fixed one and a mobile one) adopted for keeping the load steady during the wrapping cycle, a gripper for plastic film grasping including two sliding plates which opening/closing is controlled by two coupled cams, a cutting device with a serrated blade fastened to a support, and cutting during either the forward or the reverse phase of the blade itself, and electromechanical devices resolving the turn-table and operating the plastic film cutting device.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
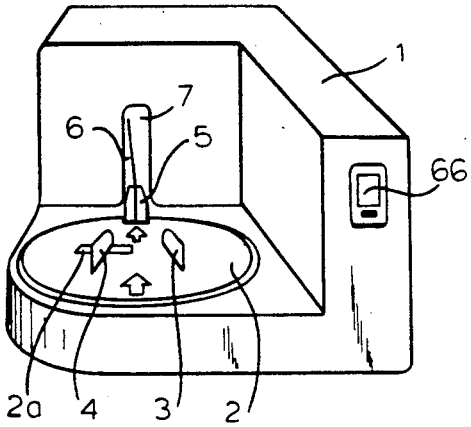
FIG. 1 is a perspective view of the unloaded machine.
Figure 2:
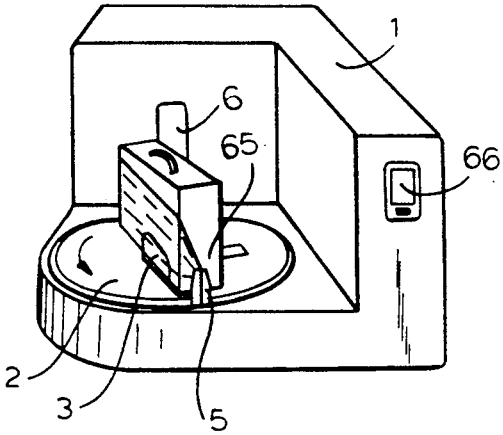
FIG. 2 is a perspective view of the machine with a suitcase during the wrapping cycle with a plastic film.
Figure 3:
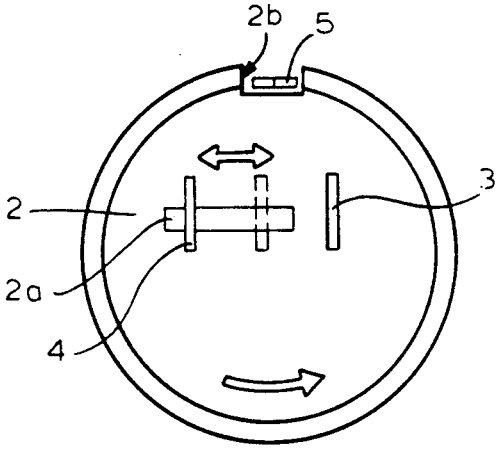
FIG. 3 is a top plan view of the load-supporting turn-table with the locating elements.

The wrapping machine comprises a housing body 1 provided with a turn-table 2 with a locating element 3 and a mobile locating element 4 connected thereto, and with a gripper 5 for grasping of the plastic film 6 through slot 7.

Turn-table 2 is also provided with a slot 2*a* allowing the displacement of the mobile locating element 4 and being of a length corresponding to the working field of the locating element, an outwardly open notch 2*b* adopted bo be a seat of the gripper 5 during specific working phases of the wrapping machine.

Figure 4:
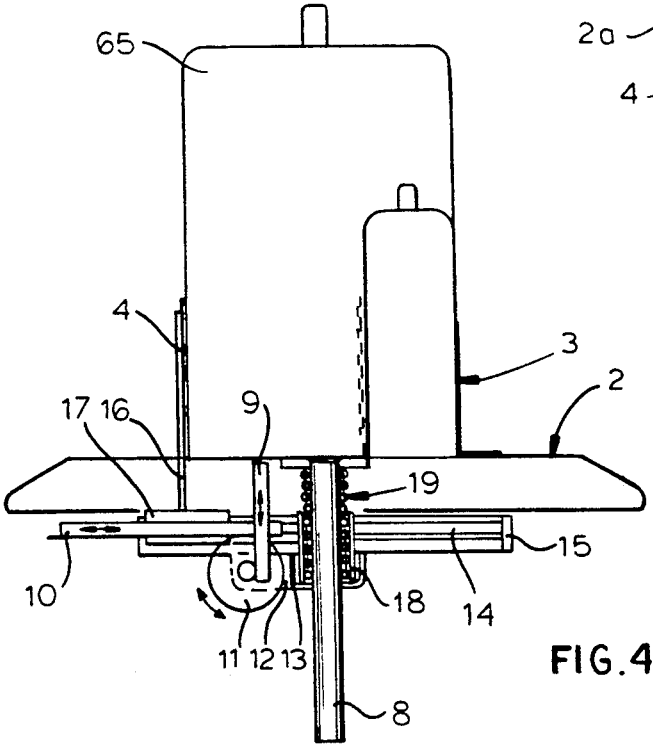
FIG. 4 is a schematic axial sectional view of the turn-table with the connected devices.

FIG. 4 illustrates a shaft 8 fastened axially to the turn-table. Movable in perpendicular directions a rack 9 connected to a rack 10 are connected with the turn-table through a double gear-wheel 11 secured to a support 13 through plate 12.

The rack 10 is sliding into the horizontal slide 14 fixed to a support 15. The mobile locating element 4 is connected to the rack 10 through a metal strip 16 and through a plate 17. The support 13 is provided with an appropriate hole to allow the vertical sliding of shaft 8 within a pipe 18 that is also a seat of a spring 19.

The support 13 is fixed with a pipe 20 (FIG. 5) within which rotates shaft 8, transmitting the rotating movement to the pipe by means of a through-pin 21. The pipe 20 is coaxial with a pipe 22 and is connected therewith by means of tapered bearings 23*a* and 23*b* that allow its rotating motion around the vertical axis 8*a* of the turn-table 2.

The pipe 22 fixed to a frame la of the body 1, interacts with a third pipe 24 by means of tapered bearings 25*a* and 25*b*. By means of a pulley 26 splined on pipe 20, it is possible to transmit the rotating motion to the turn-table 2, while pulley 27 allows transmitting the rotating motion to the pipe 24. A horizontal cam 28, on which a vertical cam 29 is soldered, is fixed to the pipe 24. The cams, appropriately shaped, operate gripper 5 through an arm 30 supporting a trunnion 31 inserted between the pairs of small pins 32*a*–32*b* and 32*c*–32*d* (FIG. 6), fixed to plates 5*a* and 5*b* forming the gripper, and sliding into guides 33*a* and 33*b*.

Figure 5:
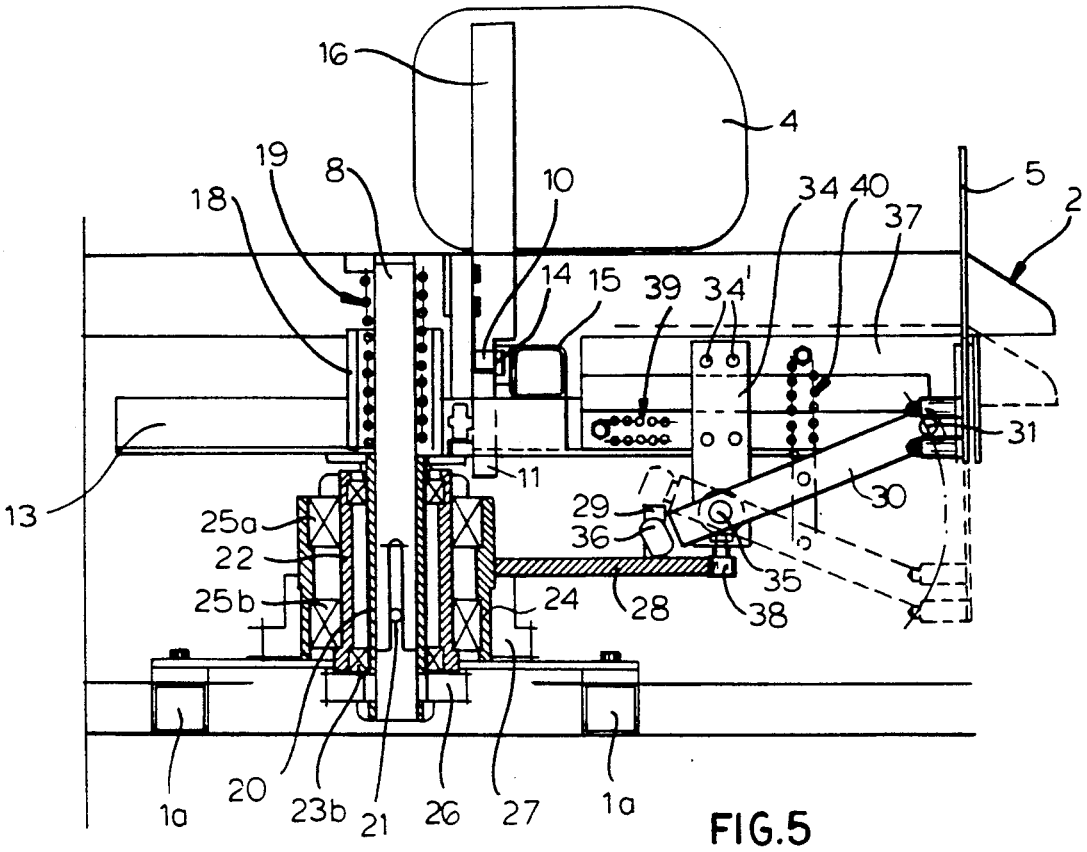
FIG. 5 is a detailed axial sectional view of the control devices of the turn-table and of the gripper for the plastic film grasping.
Figure 6:
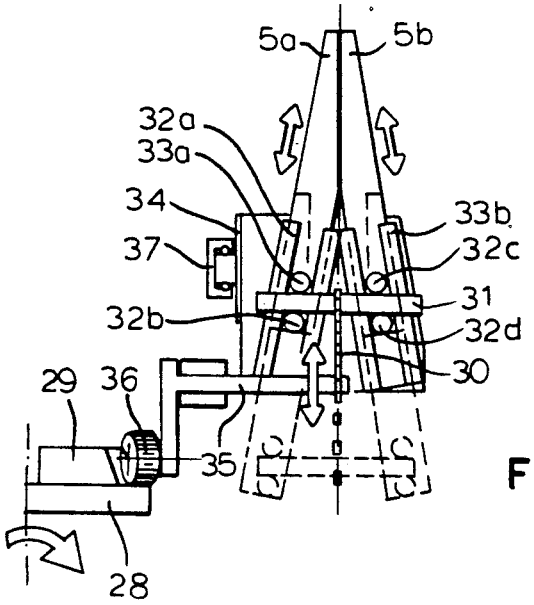
FIG. 6 is an axial view of the gripper provided with gears.

The arm 30, fastened to plate 34 having rollers 34' mounted on the guide 37 through a pin 35, has the shaped edge 36 sliding on cam 29 (FIG. 6 shows only schematically the functioning principles of the above mentioned components, illustrated in FIG. 5).

The plate 34, by means of plane guides allowing the translation is connected to the element 37 fixed to the support 13 and has roller 38 (seen in FIG. 5) being in contact with horizontal cam 28. Springs 39 and 40 ensure a continuous contact between the horizontal cam 28 and roller 38 as well as between cam 29 and element 36, having the same returning functions as mobile devices 30 and 34.

Figure 7:
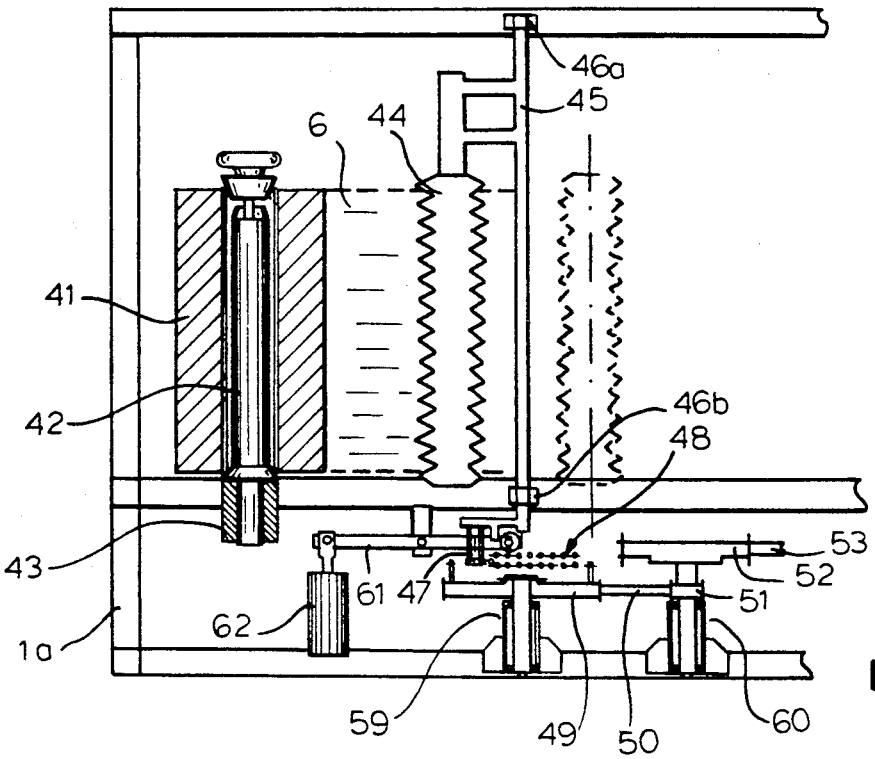
FIG. 7 is a schematic view of the plastic film cutting device.
Figure 8:
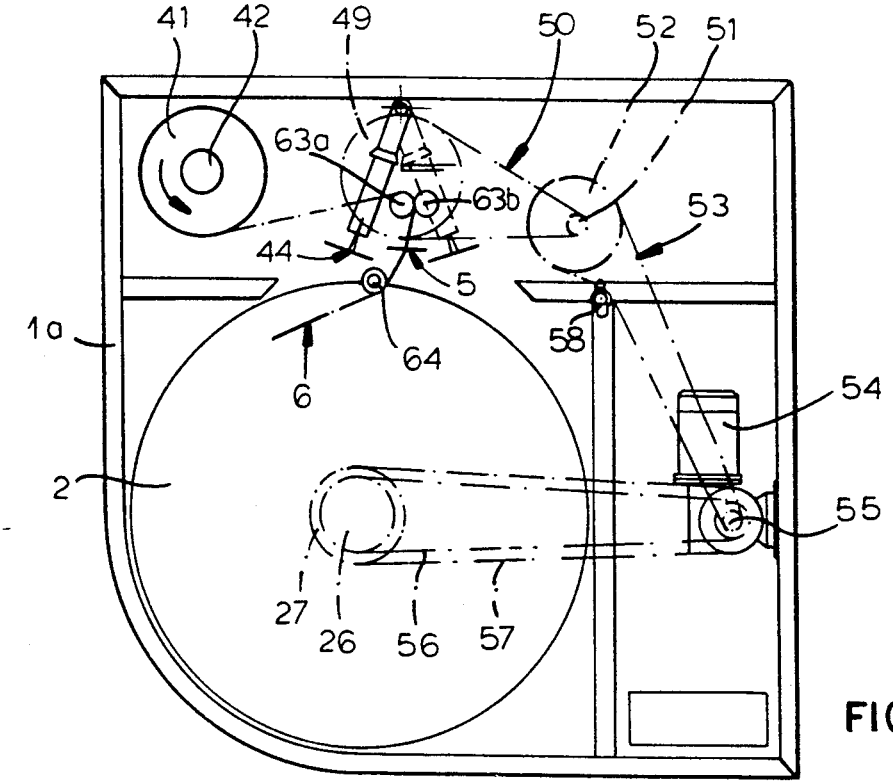
FIG. 8 is a possible kinematic chain for the main device gearing.

A basic component for the wrapping machine is a cutting device for a plastic film 6 unwinded from the reel 41 (FIG. 7) mounted on a reel-holder 42 loosely engaging the frame 1*a* by means of bushing 43 fixed to the frame. The cutting device is provided with a serrated blade 44 having two cutting edges. The blade is fixed on the upper part to a shaped bar 45 turning about its own axis in a given circular sector and fixed to the frame 1*a* by means of supports 46*a* and 46*b*. In the lower part of shaped bar 45 a pin 47 is provided with one end of a spring 48 secured thereto. The opposite end of the spring is secured to a pulley 49 operated by a toothed belt 50 through pulley 51 coaxially splined with pulley 52 operated by a belt 53 driven by a geared motor 54 (FIG. 8) to which a 3-grooved pulley 55 is connected. The 3-grooved pulley 55 drives pulleys 26 and 27 through belts 56 and 57, respectively. A belt-stretcher 58 is provided, in order to maintain the right tension on belt 53, while pulleys 49, 51 and 52 are fixed to frame 1*a*, by means of supports 59 and 60. The cutting device is completed with the levered release device 61 operated by electromagnet 62. For proper functioning of the wrapping machine the angular velocities of the pulleys 49, 51 and 55 should be different. FIG. 8 illustrates different diameters of the respective pulleys affecting inversely the respective one of angular velocities of the pulleys. The pulleys can be easily replaced by another one having different diameters. In order to allow the right unwinding of plastic film 6, the coupled idle rollers 63*a*–63*b* and idle roller 64 for the film stretching, are provided.

Figure 9A:
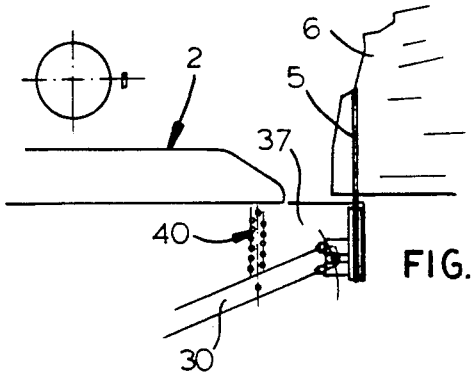
FIGS. 9 *a, b, c, d, e* and *f* shows working phases of the gripper and its relevant positions in reference to the turn-table, the load, the film and to the cutting device.
Figure 9B:
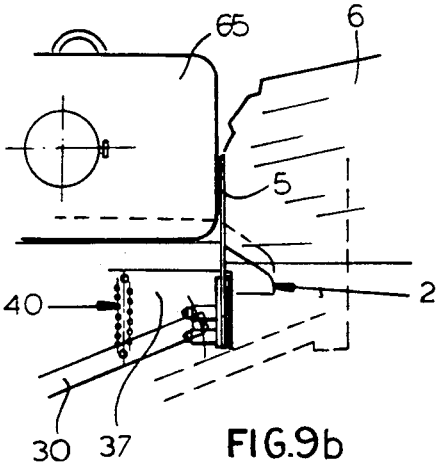

The working phases of the machine are schematically shown in FIGS. 9*a*–*f*. The starting is represented in FIG. 9*a* which shows the unloaded turn-table in its upper position by means of spring 19 and gripper 5 that holds plastic film 6. FIG. 9*b* represents the following phase, where the gripper 5 is positioned into seat 2*b* and a load 65 is put down on the turn-table 2, so that the front side rests against gripper 5 and one side against the fixed locating element 3, because of the weight of the load, turning-table 2 comes down, and by means of the movement obtained by racks 9 and 10 and by double gear-wheel 11, operates the translation of the locating element 4 at the end of its stroke, rests against the side of the suitcase 65 opposite to the one supported by the fixed locating element 3. Preventing the load from its overturn during the rotation of turn-table 2 and the wrapping with plastic film 6. At this time the load wrapping phase with a plastic film starts. In response to a predetermined number of revolutions of turn-table 2.

Figure 9C:
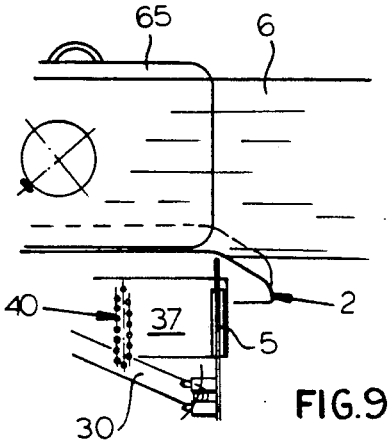

FIG. 9*c* represents the phase of gripper 5 release from film 6 resulting from the gripper's displacement in a direction 5E and subsequent opening. These movements are operated by the co-ordinate actions of cams 28 and 29 through, mobile devices 30 and 34 and the relevant functionally coupled auxiliaries.

Figure 9D:
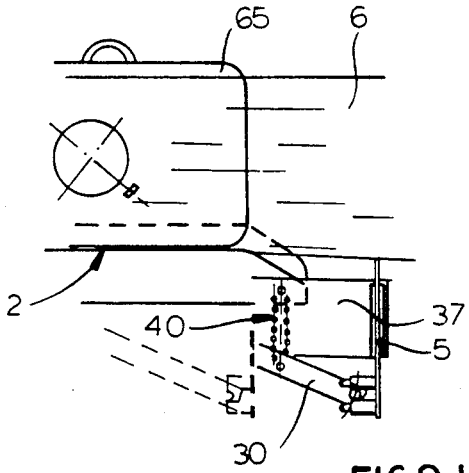
Figure 9E:
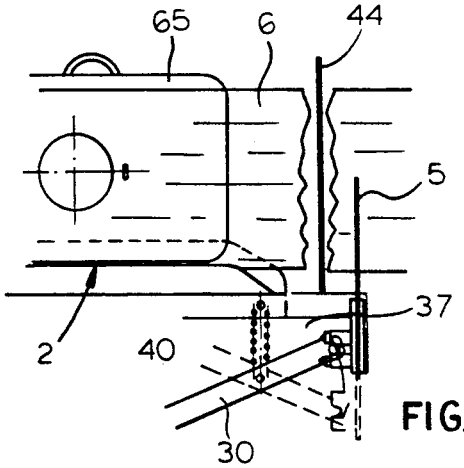

FIG. 9*d* represents gripper 5 opened in its down position and spaced from turn-table 2, while FIG. 9*e* represents the phase of film 6 cut by means of the blade 44 and grasping of a cut edge by means of gripper 5 in its upper position and closed, apart from turn-table 2. In this phase it is possible to pick suitcase 65 up, wrap it with the plastic film avoiding any casual opening and outlining of content, and at the same time protecting the suitcase from any casual shocks or scratches.

Figure 9F:
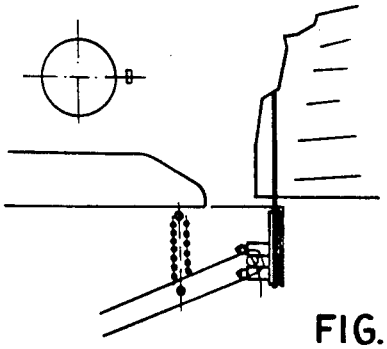

To improve film adhesion on the lower part of the suitcase for better protection of the lower corners, turn-table 2 is beveled, so that a bevel 2*a* acts as a guide for the film during its load wrapping. When suitcase 65 is picked up from turn-table 2, spring 19 will be restored, as represented in FIG. 9*f* corresponding to FIG. 9*a*.

For a better understanding of the working of the present invention in FIGS. 9*a*–9*f* the position of turn-table 2 and of gripper 5 with reference to the cartesian axes of the turn-table itself is schematically represented, o a plan view.

The finding will be provided with a control box 66 from which the working cycle of the machine will start, by means of a push-button device, after the insertion of a ticket or coin or card.

The aims of the present invention are all achieved by the finding, allowing plastic film wrapping around suitcases of the different sizes, in order to guarantee the required protection. Maneuver procedures, automatism and components are all conceived in order to allow the use without skilled operators, thus allowing the possible use of the device of the present invention at railway stations, docks, airports, where a great handling of suitcases takes place.

Practically, shapes and sizes of each component, and their working links, as well as the materials employed, can be widely varied, according to needs, and the technical details can be replaced by other equivalent ones, without departing from the scope of the invention as described.

I claim:

1. An automatic plastic film wrapping machine, said machine comprising:

a housing;

a motor mounted on the housing;

a shaft operatively connected with the motor and rotatable about an axis of rotation;

a turn-table supporting a load to be wrapped and mounted on the shaft for rotating therewith, the shaft and the turntable being mounted in the housing and being axially movable upon loading of the turntable, the turntable being provided with:

a first elongated slot having a slot axis extending perpendicular to the axis of rotation, first and second centering plates, at least first centering plate being provided with a double geared wheel operatively connected with the shaft and actuating the first plate upon axial downward displacement of the turntable to move along the first elongated slot, so that the load to be wrapped is abutted by the first and second plates at opposite sides of the load, and a notch formed in a periphery of the turntable;

a first outer cylinder spaced radially outwardly from the shaft, the first cylinder operatively connected with the motor and being rotatable about the axis and being formed with a first cam plate extending radially outwardly from the first cylinder;

a second cam plate extending at a right angle to the first cam plate and operatively connected with the first cam plate;

a gripper mounted on the housing and adapted to grasp a plastic film for wrapping the load, the gripper being operatively connected with the first and second cam plates and being movable through the notch between open and closed, inner and outer positions of the gripper, the gripper being formed with two arms disengaging the plastic film in the open position and clamping the film therebetween in the closed position of the gripper upon actuating of the cam plates; and cutting means provided with a serrated blade for severing the film and mounted on the housing, the blade being movable transversely to a plane of the plastic film and cutting the latter in forward and reverse phases thereof corresponding to the outer position of the gripper.

2. The machine defined in claim 1 wherein the housing is provided with a wall formed with a second slot juxtaposed with the notch, the gripper being movable between the inner position next to the periphery of the turntable and the outer position distant from the periphery of the table.

3. An automatic plastic film wrapping machine, said machine comprising:

a housing;

a motor mounted on the housing;

a shaft mounted on the housing operatively connected with the motor and rotatable about an axis of rotation;

a turn-table supporting a load to be wrapped and mounted on the shaft in said housing for rotating with the shaft;

a first outer cylinder spaced radially outwardly from the shaft, the first cylinder operatively connected with the motor and being rotatable about the axis and being formed with a first cam plate extending radially outwardly from the first cylinder;

a second cam plate extending at a right angle to the first cam plate and operatively connected with the first cam plate;

a gripper mounted on the housing and adapted to grasp a plastic film for wrapping the load, the gripper being operatively connected with the first and second cam plates and being movable through the notch between open and closed, inner and outer positions of the gripper, the first cam plate is provided with a first cam follower connected with a lever extending vertically upwardly, the gripper being formed with two arms disengaging the plastic film in the open position and clamping the film therebetween in the closed position of the gripper upon actuating of the cam plates;

a horizontal guide plate mounted in the housing and operatively connected with the shaft and with the lever for displacing the gripper horizontally between the inner and outer positions upon interacting of the first cam follower with the first plate; and cutting means provided with a serrated blade for severing the film and mounted on the housing, the blade being movable transversely to a plane of the plastic film and cutting the latter in forward and reverse phases thereof corresponding to the outer positions of the gripper.

4. An automatic plastic film wrapping machine, said machine comprising:

a housing;

a motor mounted on the housing;

a shaft mounted on the housing and operatively connected with the motor and rotatable about an axis of rotation;

a turn-table supporting a load to be wrapped and mounted on the shaft in said housing for rotating with the shaft;

a first outer cylinder spaced radially outwardly from the shaft, the first cylinder operatively connected with the motor and being rotatable about the axis and being formed with:

a first cam plate extending radially outwardly from the first cylinder;

a second cam plate extending at a right angle to the first cam plate and operatively connected with the first cam plate, the second cam plate being provided with a respective cam follower;

a gripper mounted on the housing and adapted to grasp a plastic film for wrapping the load, the gripper being operatively connected with the first and second cam plates and being movable through the notch between open and closed, inner and outer positions of the gripper, the gripper being formed with two arms disengaging the plastic film in the open position and clamping the film therebetween in the closed position of the gripper upon actuating of the cam plates;

a guide plate mounted in the housing and being in contact with the cam follower, said second guide plate being operatively connected with and movable angularly relative to the axis of rotation and displacing the gripper between the open and closed positions of the gripper; and cutting means provided with a serrated blade for severing the film and mounted on the housing, the blade being movable transversely to a plane of the plastic film and cutting the latter in forward and reverse phases thereof corresponding to the outer position of the gripper.

5. An automatic plastic film wrapping machine, said machine comprising:

a housing;

a motor mounted on the housing;

a shaft mounted in the housing operatively connected with the motor and rotatable about an axis of rotation;

a turn-table supporting a load to be wrapped and mounted on the shaft for rotating therewith on said housing;

a first outer cylinder spaced radially outwardly from the shaft, the first cylinder operatively connected with the motor and being rotatable about the axis and being formed with a first cam plate extending radially outwardly from the first cylinder;

a second cam plate extending at a right angle to the first cam plate and operatively connected therewith;

a gripper mounted on the housing and adapted to grasp a plastic film for wrapping the load, the gripper being operatively connected with the first and second cam plates and being movable between open and closed, inner and outer positions of the gripper, the gripper being formed with two arms disengaging the plastic film in the open position and clamping the film therebetween in the closed position of the gripper upon actuating of the cam plates;

cutting means provided with a serrated blade for severing the film and mounted on the housing, the blade being movable transversely to a plane of the plastic film and having forward and reverse cutting phases and with a support connected with the blade, said blade being rotatable about a support axis parallel to the axis of rotation, so that said plastic film is severed in said forward and reverse phases corresponding to the outer position of the gripper; and a three-grooved pulley actuated by the motor and connected with the shaft and with the first cylinder by respective belts, the cutting means being further provided with a support connected with the blade rotatable about a support axis parallel to the axis of rotation and the support being connected with the pulley by a another belt, the support and the shaft having different angular velocities.

* * * * *